US005985053A

United States Patent [19]

Hara et al.

[11] Patent Number: 5,985,053

[45] Date of Patent: Nov. 16, 1999

[54] STEEL HAVING IMPROVED TOUGHNESS IN WELDING HEAT-AFFECTED ZONE

[75] Inventors: Takuya Hara; Hitoshi Asahi; Hiroshi Tamehiro; Ryuji Uemori; Naoki Saito, all of Futtsu, Japan

[73] Assignee: Nippon Steel Corporation, Tokyo, Japan

[21] Appl. No.: 08/973,446

[22] PCT Filed: Apr. 17, 1997

[86] PCT No.: PCT/JP97/01335

§ 371 Date: Dec. 4, 1997

§ 102(e) Date: Dec. 4, 1997

[87] PCT Pub. No.: WO97/39157

PCT Pub. Date: Oct. 23, 1997

[30] Foreign Application Priority Data

Apr. 17, 1996 [JP] Japan ..... 8-095625

Dec. 16, 1996 [JP] Japan ..... 8-336174

[51] Int. Cl.[6] ..... C22C 38/14; C22C 38/28; C22C 38/50

[52] U.S. Cl. ..... 148/335; 148/334; 148/333; 148/320; 420/126; 420/110

[58] Field of Search ..... 148/320, 333, 148/334, 335, 336; 420/126, 110

*Primary Examiner*—Deborah Yes
*Attorney, Agent, or Firm*—Kenyon & Kenyon

[57] ABSTRACT

A steel having excellent HAZ toughness can be used for ships, buildings, pressure containers, linepipes, and so forth. The steel is of a Ti—Mg—O system steel containing at least 40 pcs/mm$^2$ of oxide and composite oxide particles of Ti and Mg having a size of 0.001 to 5.0 $\mu$m. A steel having excellent HAZ toughness can be produced, and the safety of structures using this steel can be remarkably improved.

3 Claims, 1 Drawing Sheet

Ti-Mg oxidazation

図1

Ti-Mg-Ca oxidazation

図2

Ta-Ti-Mg oxidazation

図3

STEEL HAVING IMPROVED TOUGHNESS IN WELDING HEAT-AFFECTED ZONE

TECHNICAL FIELD

Figure 1:
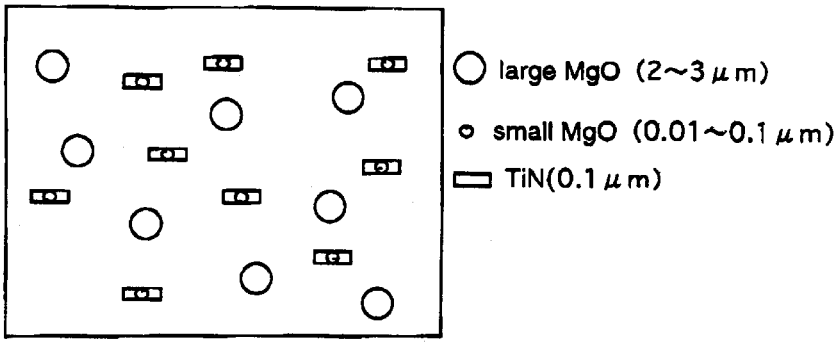
Figure 2:
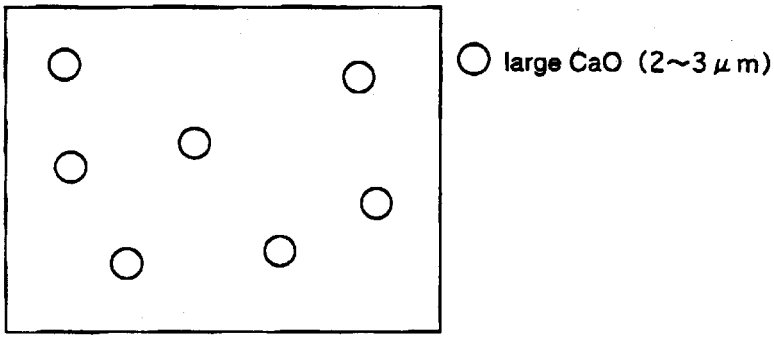
Figure 3:
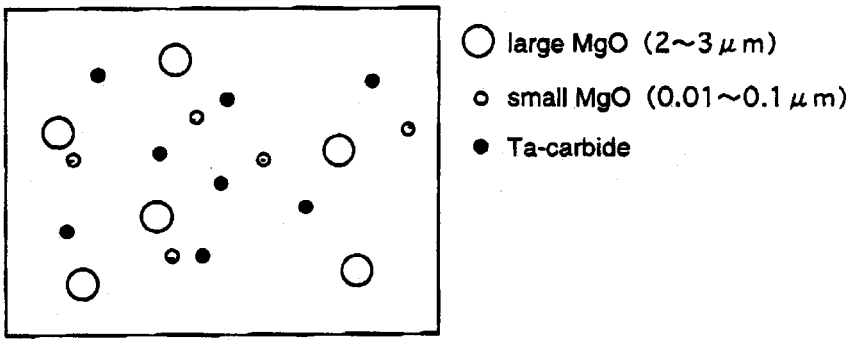

This invention relates to a steel having excellent low temperature toughness at a welding heat affected zone (HAZ), and can be applied to structural steel materials to which arc welding, electron beam welding, laser welding, etc, are applied.

More particularly, this invention relates to a steel having excellent HAZ toughness by adding Ti and Mg to a steel, controlling an O quantity and finely dispersing oxides and composite oxides of these elements.

BACKGROUND ART

One of the most important characteristics required for steel materials used for structures such as ships, buildings, pressure containers, linepipes, etc, is HAZ toughness. Recently, heat-treating technologies, controlled rolling and machining heat-treating method have made a remarkable progress, and the improvement of low temperature toughness of the steel material itself has become easy. Because the welding HAZ is reheated to a high temperature, however, the fine structure of the steel material is completely lost, and its microscopic structure becomes extremely coarse to thereby invite drastic deterioration of HAZ toughness. Therefore, as means for refining the HAZ structure, (1) a technology for limiting coarsening of austenite grains by TiN and (2) a technology for forming intergranular ferrite by Ti oxides, have been examined and put into practical application. For example, CAMP-ISIJ Vol. 3 (1990) 808 describes the influences of N on intergranular ferrite transformation in Ti oxide type steels, and Vol. 79 (1993) No. 10 describes the effect of B on intergranular ferrite transformation in Ti-containing oxide steels. Nonetheless, the level of HAZ toughness produced by these technologies is not yet entirely satisfactory. From the aspect of execution of welding, therefore, a steel material which has higher strength and can be used at a low temperature and with a large heat input has been strongly desired.

DISCLOSURE OF THE INVENTION

The present invention provides a steel material having excellent HAZ toughness (such as a thick steel plates, a hot coil, a shape steel, a steel pipe, etc).

The inventors of the present invention have conducted intensive studies on the chemical components (compositions) of steel materials and their microscopic structures in order to improve their HAZ toughness, and have invented a novel steel having high HAZ toughness.

The gist of the present invention resides in a steel which contains, in terms of wt %:

C: 0.01 to 0.15,

Si: not greater than 0.6,

Mn: 0.5 to 2.5,

P: not greater than 0.030,

S: not greater than 0.005,

Ti: 0.005 to 0.025,

Al: not greater than 0.02,

Mg: 0.0001 to 0.0010

O: 0.001 to 0.004, and

N: 0.001 to 0.006 further contains, whenever necessary, at least one of the following component:

Nb: 0.005 to 0.10,

V: 0.001 to 0.10,

Ni: 0.05 to 2.0,

Cu: 0.05 to 1.2,

Cr: 0.05 to 1.0,

Mo: 0.05 to 0.8, and the balance consisting of Fe and unavoidable impurities; and contains at least 40 pcs/mm$^2$ of oxides and composite oxides of Ti and Mg having a grain size of 0.001 to 5.0 $\mu$m.

When the steel described above is molten, metallic Mg wrapped by an iron foil is used as a Mg addition element.

Hereinafter, the content of the present invention will be explained.

The term "%" used in the following description means "wt %".

The feature of the present invention resides in that trace Ti and Mg are simultaneously added to a low carbon steel and oxides and composite oxides containing Ti and Mg (containing additionally MnS, CuS, TiN, etc) are finely dispersed into the steel by controlling the (oxygen) quantity.

Here, the term "oxides and composite oxides containing Ti and Mg (containing additionally MnS, CuS, TiN, etc)" mainly means compounds such as Ti oxides, Mg oxides or composite oxides of Ti and Mg in the steel, oxides and composite oxides of other elements such as Mn, Si, Al, Zr, etc, and compounds such as sulfides and composite sulfides of Mn, Cu, Ca, Mg, etc. These compounds may further contain nitrides such as TiN.

It has been clarified that the finely dispersed Ti and Mg composite oxides restrict (1) formation of fine intergranular ferrite in the austenite grains that have become coarse and/or (2) coarsening of the austenite grains, make the HAZ structure fine and drastically improve the HAZ toughness. Moreover, the improvement of the HAZ toughness can be attained by the Mg quantity in the steel and the kind of the Mg addition elements. In other words, it has been found out that when pure Mg metal (at least 99%) is wrapped by an iron foil and is added, the item (1) exhibits its effect when the Mg quantity is not greater than 0.0020% and the item (2) exhibits its effect when the Mg quantity exceeds 0.0020%. In addition, the sizes and densities of the Ti and Mg composite oxides are important factors.

However, there is the case where the oxide of Mg alone exists besides the Ti and Mg composite oxide when the Mg quantity is great, and there is also the case where the oxide of Ti alone exists besides the Ti and Mg composite oxide when the Mg quantity is small. However, there occurs no problem so long as the sizes of the individual oxides of Ti and Mg and the Ti and Mg composite oxides are from 0.001 to 5.0 $\mu$m because they are finely dispersed. The sizes of the oxide or the composite oxide is preferably 0.001 to 2 $\mu$m.

It has been also clarified that this composite oxide is dispersed in a greater quantity and more finely than the Ti oxide formed at the time of addition of Ti alone, and its effects on the items (1) and (2) described above are also greater. To obtain such effects, it is first necessary to limit the Ti and Mg quantities to 0.005 to 0.25% and 0.0001 to 0.0010%, respectively. These quantities are the minimum quantities necessary for finely dispersing large quantities of the composite oxides. The upper limit of the Ti quantity must be 0.025% in order to prevent deterioration of the low temperature toughness due to the formation of TiC at the HAZ, though the Ti quantity varies with the O and N quantities. It is extremely difficult from the aspect of steel production to disperse large quantity of Mg oxides and for this reason, the upper limit of the Mg quantity is set to 0.0010%.

When the size of the Ti and Mg composite oxide is less than 0.001 μm, the oxide is so small that the restriction effect of coarsening of the austenite grain or the formation effect of the intergranular ferrite cannot be obtained. When the size exceeds 5.0 μm, the oxide is so large that the restriction effect of coarsening of the austenite grains or the formation effect of the intergranular ferrite cannot be obtained, either. When the density of the Ti and Mg composite oxide is less than 40 pcs/mm$^2$, the number of oxides dispersed is so small that the effect of intergranular transformation cannot be obtained. Therefore, the density of at least 40 pcs/mm$^2$ is necessary. To obtain finer Ti and Mg oxides in greater quantities, limitation of the O quantity is important. When the O quantity is too small, large quantities of the composite oxides cannot be obtained and when it is too great, on the contrary, the cleanness of the steel is deteriorated. Therefore, the O quantity is limited to 0.001 to 0.004%.

Hereinafter, the reasons for limitation of the component elements will be explained.

The C quantity is limited to 0.01 to 0.15%. Carbon is an extremely effective element for improving the strength of the steel, and at least 0.01% is necessary so as to obtain the fining effect of the crystal grains. When the C quantity is too great, the base metal and the low temperature toughness of the base metal and the HAZ are extremely deteriorated. Therefore, the upper limit is set to 0.15%.

Silicon is the element added for deoxidation and for improving the strength. When its quantity is too great, however, the HAZ toughness is remarkably deteriorated, and the upper limit is therefore set to 0.6%. Deoxidation of the steel can be made sufficiently even by Ti or Al, and Si need not be always added.

Manganese is an indispensable element for securing the balance of strength and the low temperature toughness and its lower limit is 0.5%. When the Mn quantity is too great, however, hardenability of the steel increases, so that not only the HAZ toughness is deteriorated but center segregation of continuous casting (slab) is promoted and the low temperature toughness of the base metal is deteriorated, too. Therefore, the upper limit is set to 2.5%.

The addition of Ti forms fine TiN, restricts coarsening of the austenite grains at the time of re-heating of the slab and the HAZ, makes fine the microscopic structure and improves the low temperature toughness of the base metal and the HAZ. When the Al quantity is small, Ti forms oxides, functions as the intergranular ferrite formation nuclei in the HAZ and makes fine the HAZ structure. To obtain such a Ti addition effect, at least 0.005% of Ti must be added. If the Ti quantity is too great, however, coarsening of TiN and precipitation hardening due to TiC occur. Therefore, its upper limit is set to 0.025%.

Aluminum is the element which is generally contained in the steel as the deoxidizing element. However, when the Al quantity exceeds 0.02%, the Ti and Mg composite oxides cannot be easily formed. Therefore, its upper limit is set to 0.020%. Deoxidation can be sufficiently achieved by Ti or Si, and Al need not always be added.

Magnesium is a strong deoxidation element and forms fine oxides (composite oxides containing trace Ti, etc) when it combines with oxygen. The Mg oxides finely dispersed in the steel are stabler even at a high temperature than TiN, restrict coarsening of the gamma-grains in the entire HAZ or form the fine intergranular ferrite inside the coarsened austenite grains, and improve the HAZ toughness. To obtain such effects, at least 0.0001% of Mg is necessary. However, it is extremely difficult from the aspect of steel production to add a large quantity of Mg into the steel. Therefore, its upper limit is set to 0.0010%.

It is effective to reduce the quantity of the strong deoxidation element Al as much as possible and to control the O quantity to 0.001 to 0.01% in order to sufficiently obtain the fine oxides at the time of the addition of Ti and Mg.

Nitrogen forms TiN, restricts coarsening of the austenite grains at the time of reheating of the slab and in the welding HAZ, and improves the low temperature toughness of the base metal and the HAZ. The minimum quantity necessary for this purpose is 0.001%. When the N quantity is too great, however, surface scratching of the slab and deterioration of the HAZ toughness due to solid solution N occur. Therefore, the upper limit must be set to 0.006%.

In the present invention, the P and S quantities as the impurity elements are limited to not greater than 0.030% and not greater than 0.005%, respectively. The main reason is to further improve the low temperature toughness of the base metal and the HAZ. Reduction of the P quantity reduces the center segregation of the slab, prevents the grain boundary destruction and improves the low temperature toughness. Reduction of the S quantity reduces MnS stretched by controlled rolling and improves the toughness.

Next, the object of the addition of Nb, V, Ni, Cu, Cr and Mo will be explained.

The main object of addition of these elements to the fundamental components is to further improve the characteristics such as the strength/low temperature toughness, HAZ toughness, etc, and to enlarge the producible steel size without deteriorating the excellent features of the steel of the present invention. Therefore, their addition quantities must be naturally limited.

When co-present with Mo, Nb restricts recrystallization of the austenite during controlled rolling, makes fine the crystal grains but contributes to the improvement of precipitation hardening and hardenability and to make the steel tough and strong. At least 0.005% of Nb is necessary. When the Nb addition quantity is too great, however, the HAZ toughness is adversely affected. Therefore, its upper limit is set to 0.10%.

Vanadium has substantially the same effect as Nb but its effect is believed to be weaker than that of Nb. At least 0.01% of V must be added, and the upper limit is set to 0.10% from the aspect of the HAZ toughness.

Nickel is added in order to improve the strength and the low temperature toughness. It has been discovered that in comparison with the addition of Mn, Cr and Mo, the addition of Ni forms less of the hardened structure, which is detrimental to the low temperature toughness, in the rolled structure (particularly, in the center segregation zone of the slab) and the addition of a trace quantity of Ni is also effective for improving the HAZ toughness (a particularly effective Ni quantity for the HAZ toughness is at least 0.3%.) If the addition quantity is too great, however, not only the HAZ toughness is deteriorated but the economic effect is also spoiled. Therefore, its upper limit is set to 2.0%. The addition of Ni is also effective for preventing Cu cracking during continuous casting and hot rolling. In this case, Ni must be added in a quantity of at least ⅓ of the Cu quantity.

Copper has substantially the same effect as Ni and is effective for improving corrosion resistance and hydrogen induced cracking resistance characteristics. The addition of Cu in a quantity of at least about 0.5% drastically improves the strength due to precipitation hardening. When it is added excessively, however, a drop in the toughness of the base metal and the HAZ due to precipitation hardening and the occurrence of crack during hot rolling develops due to precipitation hardening. Therefore, its upper limit is set to 1.2%. Chromium increases the strength of the base metal and the welded portion. However, when its quantity is too great, the HAZ toughness is remarkably deteriorated. Therefore, the upper limit of the Cr quantity is set to 1.0%.

Molybdenum strongly restricts recrystallization of the austenite during controlled rolling when co-present with Nb, and is effective also for fining the austenite structure. However, the excessive addition of Mo deteriorates the HAZ toughness, and its upper limit is set to 0.80%.

The lower limit of 0.05% of each of Ni, Cu, Cr and Mo is the minimum quantity at which the effect on the material due to the addition of these elements becomes remarkable.

Next, the size and the number of the Ti and Mg composite oxide particles will be explained.

When the size of the Ti and Mg composite oxide particles is less than 0.001 μm, the effect of the formation of the intergranular ferrite or the restriction effect of coarsening of the austenite grains cannot be obtained, and when it exceeds 5.0 μm, the oxide particles become so large that the oxide does not provide the formation effect of the intergranular ferrite, and the restriction effect of coarsening of the austenite grains cannot be obtained.

When the density of the Ti and Mg composite oxide particles is less than 40 pcs/mm$^2$, the number of the oxide particles dispersed is small and the oxide particles are not effective for intergranular transformation. Therefore, the lower limit is set to at least 40 pcs/mm$^2$.

By the way, the density of the oxides of Ti and Mg alone or their composite oxide is determined by collecting a sample from a position of ¼ thickness, irradiating a beam of a 1 μm diameter to the range of 0.5 mm×0.5 mm on the sample surface by using a CMA (Computer Micro-Analyzer) and calculating the number of oxide particles unit area.

Next, the Mg addition material will be explained. The present invention uses metallic Mg (at least 99%) wrapped by an iron foil as the Mg addition material and melts it to a steel. If metallic Mg is directly charged into the molten steel, the reaction is so vigorous that the molten steel is likely to scatter. Therefore, metallic Mg is wrapped by the iron foil. The reason why the iron foil is used is to prevent impurity elements from entering the molten steel but no problem occurs when the foil of an iron alloy having substantially the same composition as that of the product is used. Incidentally, a Mg alloy such as an Fe—Si—Mg alloy or a Ni—Mg alloy may be used as the Mg addition material.

BEST MODE FOR CARRYING OUT THE INVENTION

Ingots of various Mg-containing steels, to which pure Mg metal (at least 99%) was added while being wrapped by an iron foil, were produced by laboratory melting. These ingots were rolled to plates having thickness of 13 to 30 mm under various conditions and their mechanical properties were examined. The mechanical properties (yield strength: YS, tensile strength: TS, absorption energy of Charpy impact energy at −40° C.: $vE_{-40}$ and Charpy impact transition temperature: vTrs) were examined in a transverse direction. The HAZ toughness (Charpy impact energy at −20° C.: $vE_{-20}$) was evaluated by HAZ reproduced by a reproduction heat cycle apparatus (maximum heating temperature: 1,400° C., cooling time from 800 to 500° C. [$\Delta t_{800-500}$]: 27 sec). The sizes and numbers of the Ti and Mg composite oxide particles were examined by effecting CMA analysis using a 1 μm diameter beam.

The oxide particles were determined by electron microscope observation.

Examples were tabulated in Table 1. The steel sheets produced in accordance with the present invention had Charpy impact energy of at least 150 J in the HAZ at −20° C., and had excellent HAZ toughness. In contrast, since the Comparative Steels had unsuitable chemical components or unsuitable sizes or densities of the Ti and Mg composite oxide particles, their Charpy impact energy in the HAZ at −20° C. was extremely inferior.

Since the O quantity was small in Steel No. 15, the density of the Ti and Mg composite oxide particles was small and the Charpy impact energy in the HAZ was low. Since the Al quantity was too great in Steel No. 16, the density of the Ti and Mg composite oxide particles hardly existed and the Charpy impact energy in the HAZ was low. Since the Ti quantity was too small in Steel No. 17, the density of the Ti and Mg composite oxide particles was small and the Charpy impact energy in the HAZ was low. Since the Ti quantity was great in Steel No. 18, the Charpy impact energy in the HAZ was somewhat low. Since the O quantity was great in Steel No. 19, the grain size of the Ti and Mg composite oxide particles was great and the Charpy impact energy in the HAZ was low. Since Mg was not added to Steel No. 20, the Charpy impact energy in the HAZ was somewhat low.

TABLE 1

Table 1-1

| Steel | | Chemical compositions (wt %, *PPm) | | | | | | | | | | |
|---|---|---|---|---|---|---|---|---|---|---|---|---|
| | | C | Si | Mn | P* | S* | Ti | Al | N* | O* | Mg* | Others |
| Present | 1 | 0.060 | 0.29 | 1.96 | 120 | 20 | 0.012 | 0.002 | 33 | 30 | 3 | Ni: 0.42, Cu: 0.98, Mo: 0.42, Nb: 0.040 |
| inventive | 2 | 0.090 | 0.35 | 1.72 | 65 | 18 | 0.015 | 0.004 | 45 | 40 | 4 | Ni: 0.50, Cu: 1.07 Nb: 0.026 |
| steel | 3 | 0.065 | 0.20 | 1.85 | 74 | 13 | 0.024 | 0.003 | 59 | 33 | 8 | Cr: 0.38, Cu: 1.00, Ni: 0.40, Nb: 0.026 |
| | 4 | 0.070 | 0.29 | 1.82 | 52 | 17 | 0.018 | 0.002 | 48 | 42 | 7 | Mo: 0.50, Cu: 0.99, Ni: 0.35, Nb: 0.040 |
| | 5 | 0.071 | 0.25 | 1.71 | 128 | 18 | 0.020 | 0.003 | 37 | 20 | 10 | Ni: 0.45, Cu: 1.03 |
| | 6 | 0.069 | 0.05 | 1.92 | 84 | 16 | 0.018 | 0.002 | 39 | 22 | 8 | V: 0.071, Mo: 0.42, Cu: 0.96, Ni: 0.35 |
| | 7 | 0.078 | 0.24 | 1.84 | 65 | 10 | 0.019 | 0.002 | 30 | 33 | 9 | Ni: 0.38, V: 0.080, Cu: 0.99, Nb: 0.040 |
| | 8 | 0.070 | 0.15 | 1.95 | 78 | 15 | 0.015 | 0.005 | 38 | 40 | 4 | V: 0.08, Cu: 0.10, Ni: 0.35, Nb: 0.040 |
| | 9 | 0.127 | 0.28 | 1.71 | 70 | 18 | 0.018 | 0.004 | 39 | 26 | 4 | Ni: 0.39, Cu: 0.90 Nb: 0.030 |
| | 10 | 0.072 | 0.20 | 1.84 | 40 | 17 | 0.016 | 0.002 | 46 | 30 | 2 | Mo: 0.43, Cu: 0.92, Ni: 0.35 |
| | 11 | 0.080 | 0.26 | 2.17 | 160 | 18 | 0.017 | 0.002 | 32 | 29 | 8 | Cr: 0.40, Cu: 0.93, Ni: 0.35 |
| | 12 | 0.072 | 0.20 | 1.75 | 40 | 10 | 0.015 | 0.005 | 46 | 16 | 9 | Ni: 0.38, Cu: 0.93 |
| | 13 | 0.075 | 0.29 | 1.96 | 60 | 15 | 0.020 | 0.002 | 39 | 20 | 5 | Mo: 0.42, Cu: 0.90, Ni: 0.34 |
| | 14 | 0.082 | 0.40 | 1.87 | 90 | 24 | 0.018 | 0.003 | 35 | 28 | 3 | Ni: 0.42, Mo: 0.45, Cu: 1.01, Nb: 0.039 |

TABLE 2

Table 1-2

| Steel | | Mg, Ti Composite oxides: Average particle diameter (μm) | Mg, Ti Composite oxides: Density (particle/mm$^2$) | YS (MPa) | Mechanical properties: TS (MPa) | Mechanical properties: $vE_{-40}$ (J) | Mechanical properties: vTrs (° C.) | HAZ Toughness: $vE_{-20}$ (J) |
|---|---|---|---|---|---|---|---|---|
| Present inventive steel | 1 | 1.1 | 80 | 855 | 990 | 200 | −90 | 190 |
| | 2 | 0.5 | 85 | 900 | 1000 | 180 | −80 | 165 |
| | 3 | 2.0 | 89 | 810 | 950 | 185 | −85 | 160 |
| | 4 | 1.3 | 85 | 796 | 902 | 190 | −85 | 180 |
| | 5 | 0.6 | 80 | 851 | 970 | 190 | −90 | 160 |
| | 6 | 1.0 | 88 | 852 | 953 | 180 | −80 | 165 |
| | 7 | 0.5 | 80 | 876 | 982 | 190 | −85 | 165 |
| | 8 | 1.0 | 85 | 796 | 940 | 200 | −85 | 195 |
| | 9 | 1.1 | 90 | 857 | 958 | 160 | −75 | 150 |
| | 10 | 1.3 | 81 | 856 | 963 | 159 | −65 | 150 |
| | 11 | 0.6 | 86 | 897 | 977 | 194 | −85 | 168 |
| | 12 | 0.3 | 83 | 840 | 973 | 201 | −85 | 152 |
| | 13 | 0.1 | 80 | 791 | 902 | 190 | −60 | 156 |
| | 14 | 1.5 | 82 | 810 | 821 | 180 | −80 | 158 |

TABLE 3

Table 1-3

| Steel | | Chemical compositions (wt %, *PPm): C | Si | Mn | P* | S* | Ti | Al | N* | O* | Mg* | Others |
|---|---|---|---|---|---|---|---|---|---|---|---|---|
| Comparative steel | 15 | 0.077 | 0.26 | 1.78 | 55 | 13 | 0.019 | 0.001 | 55 | 5 | 6 | V: 0.070, Cu: 0.10, Ni: 0.35, Nb: 0.026 |
| | 16 | 0.073 | 0.26 | 1.86 | 45 | 26 | 0.015 | 0.025 | 35 | 14 | 4 | V: 0.080, Ni: 0.45, Cu: 0.10, Nb: 0.038 |
| | 17 | 0.072 | 0.26 | 1.86 | 50 | 16 | 0.004 | 0.005 | 34 | 26 | 4 | Ni: 0.35 |
| | 18 | 0.078 | 0.26 | 1.86 | 50 | 16 | 0.030 | 0.004 | 37 | 16 | 8 | Mo: 0.42 |
| | 19 | 0.078 | 0.26 | 1.86 | 50 | 16 | 0.013 | 0.004 | 38 | 50 | 4 | Cu: 0.44 Nb: 0.038 |
| | 20 | 0.078 | 0.28 | 1.86 | 50 | 16 | 0.014 | 0.004 | 30 | 30 | 0 | Cr: 0.60 Nb: 0.034 |

TABLE 4

Table 1-4

| Steel | | Mg, Ti Composite oxides: Average particle diameter (μm) | Mg, Ti Composite oxides: Density (particle/mm$^2$) | YS (MPa) | Mechanical properties: TS (MPa) | Mechanical properties: $vE_{-40}$ (J) | Mechanical properties: vTrs (° C.) | HAZ Toughness: $vE_{-20}$ (J) |
|---|---|---|---|---|---|---|---|---|
| Comparative steel | 15 | 2.0 | 10 | 754 | 865 | 150 | −90 | 20 |
| | 16 | 1.5 | 7 | 812 | 930 | 80 | −80 | 30 |
| | 17 | 2.5 | 38 | 832 | 820 | 180 | −65 | 40 |
| | 18 | 2.1 | 80 | 716 | 835 | 160 | −90 | 70 |
| | 19 | 5.1 | 70 | 725 | 838 | 99 | −75 | 45 |
| | 20 | 5.3 | 70 | 759 | 851 | 110 | −85 | 30 |

INDUSTRIAL APPLICABILITY

The present invention can stably mass-produce a steel material which has excellent HAZ toughness and can be used for structures such as ships, buildings, pressure containers, linepipes, and so forth. As a result, the safety of ships, buildings, pressure containers and pipelines can be remarkably improved.

We claim:

1. A steel having excellent toughness at a welding heat affected zone, consisting of, in terms of wt %:

C: 0.01 to 0.15,

Si: not greater than 0.6,

Mn: 0.5 to 2.5,

P: not greater than 0.030,

S: not greater than 0.005,

Ti: 0.005 to 0.025,

Al: not greater than 0.02,

Mg: 0.0001 to 0.0010,

O: 0.001 to 0.004,

N: 0.001 to 0.006, and the balance of Fe and unavoidable impurities, and containing at least 40 pcs/mm$^2$ of oxide and composite oxide particles of Ti and Mg having a grain size of 0.001 to 5.0 $\mu$m.

2. A steel having excellent toughness at a welding heat affected zone according to claim 1, which further consisting of at least one of the following members:

Nb: 0.005 to 0.10,

V: 0.01 to 0.10,

Ni: 0.05 to 2.0,

Cu: 0.05 to 1.2,

Cr: 0.05 to 1.0, and

Mo: 0.05 to 0.8, and which contains at least 40 pcs/mm$^2$ of oxides and composite oxide particles of Ti and Mg having a grain size of 0.001 to 5.0 $\mu$m.

3. A steel having excellent toughness at a welding heat affected zone according to claim 1, which is a steel produced by using metallic Mg wrapped by an iron foil as a Mg addition material.

* * * * *